US005288085A

United States Patent [19]

Young

[11] Patent Number: 5,288,085

[45] Date of Patent: Feb. 22, 1994

[54] TABLE RACKET BALL GAME DEVICE

[75] Inventor: Robert G. Young, 2301 30th St., Lubbock, Tex. 79411

[73] Assignee: Robert G. Young, Lubbock, Tex.

[21] Appl. No.: 41,862

[22] Filed: Apr. 2, 1993

[51] Int. Cl.[5] ..... A63F 7/06

[52] U.S. Cl. ..... 273/85 D; 273/119 R; 273/129 W; 273/342

[58] Field of Search ..... 273/342, 118 R, 119 R, 273/121 R, 121 D, 122 R, 129 W, 85 C, 85 D

[56] References Cited

U.S. PATENT DOCUMENTS

| | | | |
|---|---|---|---|
| 1,163,102 | 12/1915 | Morgan | 273/119 R |
| 3,064,978 | 11/1962 | Burch | 273/119 R |
| 3,400,930 | 9/1968 | Leonhart | 273/85 D |
| 3,537,707 | 11/1970 | Goldberg | 273/85 D X |
| 4,046,380 | 9/1977 | Goldfarb et al. | 273/119 R |
| 4,078,797 | 3/1978 | Bergee | 273/850 |
| 4,146,227 | 3/1979 | Kuna | 273/119 R |
| 4,286,785 | 3/1981 | Todokoro | 273/119 R X |
| 4,313,605 | 2/1982 | Stokes | 273/85 C |
| 4,867,454 | 9/1989 | Horvath et al. | 273/119 R |

FOREIGN PATENT DOCUMENTS

| | | | |
|---|---|---|---|
| 642882 | 5/1964 | Belgium | 273/85 D |
| 925198 | 3/1947 | France | 273/85 D |
| 926869 | 4/1947 | France | 273/85 D |
| 1040225 | 5/1953 | France | 273/85 D |
| 1066421 | 1/1954 | France | 273/85 D |
| 1076586 | 4/1954 | France | 273/85 D |
| 1085457 | 7/1954 | France | 273/85 D |
| 1209227 | 9/1959 | France | 273/119 R |
| 7414389 | 5/1976 | Netherlands | 273/85 D |
| 221463 | 5/1942 | Switzerland | 273/85 D |
| 502165 | 1/1939 | United Kingdom | 273/85 C |
| 1075415 | 7/1967 | United Kingdom | 273/85 D |

OTHER PUBLICATIONS

Flippo Advertisement, Amsco Toys 1966 Catalog 1 page Dec. 1966.

*Primary Examiner*—William H. Grieb

[57] ABSTRACT

This new invention is a table Racket Ball Game Device.

This new invention is an enclosed table game device played with a table tennis type ball, off the sides, bottom and top, in three dimensions.

This new table game device is a game of skill not chance. This is a serious game almost anyone can learn to play. It teaches eye-hand coordination and concentration.

The ball is hand loaded, on to the paddle, aimed and carefully shot, at the other player's goal, with just a flick of the fingers.

Players score points when the ball falls out of play behind the defender's defense and down the ball return ramp.

The paddles are designed and mounted in such a way that the entire surface maybe used in defense.

This is a game of skill not chance because the players can defend every shot if they can slide the paddle quick enough to block the oncoming shot.

3 Claims, 3 Drawing Sheets

TABLE RACKET BALL GAME DEVICE

OBJECTIVES

The main objective is to build a table racket ball device almost anyone can play siting, in three dimensions.

This invention relates to a new and useful table ball game device, that would provide challenging entertainment and skill development, on a small scale, with comparative objectives in games such as Racket Ball, Table Tennis and Table Soccer.

The second goal is to provide a table racket ball type game of skill, in which the player can load, calculate, aim, shoot and defend, in three dimensions, by bouncing the a light weight ball off the slanted playing deck, the top or the sides.

The third objective is to provide a paddle that can hold the ball while serving, with little chance of falling off.

The fourth objective is to design a paddle that can defend every shot, whether over or under the paddle rod.

The fifth objective is to build a beautiful, durable, inexpensive table racket ball game device, with a minimum number of moving parts and little or no maintenance.

These objectives and other advantages will become apparent in the following background and drawings, which illustrate various practical forms of this invention.

DESCRIPTION OF THE PARTS

Part 1 is the clear top
Part 2 are the ball stops
Part 3 is the slanted play deck
Part 4 are the paddles
Part 5 are the nylon bearings
Part 6 are the rubber handles
Part 7 are the serving holes
Part 8 are the loading holes
Part 9 are the ball exit holes
Part 10 are the ball return ramps
Part 11 are the paddle rods
Part 12 are the energy damping curtains or nets
Part 13 is the ball
Part 14 is the interior wall of the game device

BACKGROUND

This new invention is a table game device, that mimics Racket Ball's three dimensional play.

Figure 7:
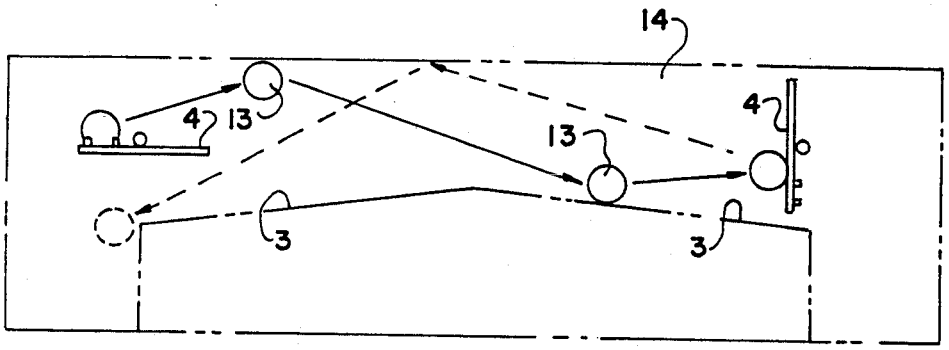
FIG. 7 is a schematic illustrating three dimensional bounce shots off the top and slanted play deck
Figure 8:
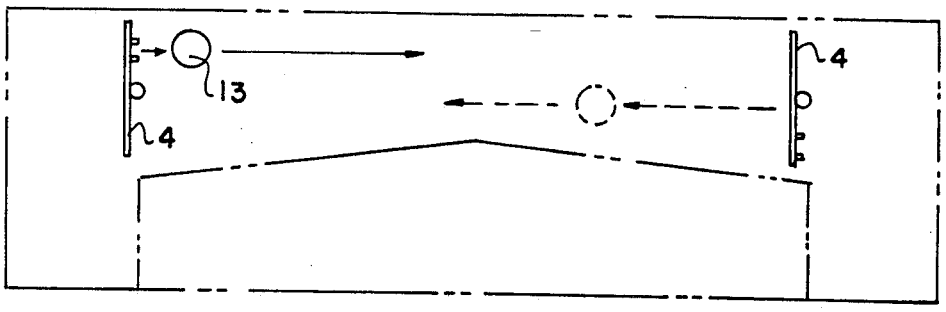
FIG. 8 is a schematic illustrating the straight over and under shots
Figure 9:
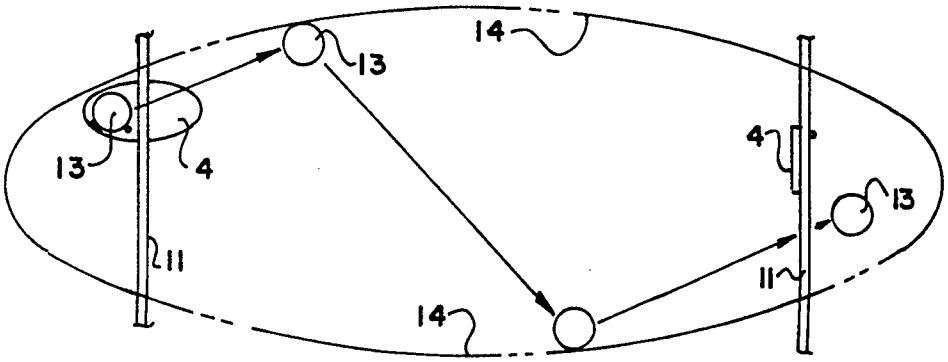
FIG. 9 is a schematic illustrating combination side bounce shots

The object of the game is to bounce the light weight ball 13 past the opponent's defense FIG. 7, 8, 9. The ball 13 can be played off the sides FIG. 9, the top FIG. 7, the slanted play deck FIG. 7 or straight over and under shots FIG. 8.

As in many table games an energy absorbing curtain or net 12 is used to absorb the energy and drop the ball 13 down the ball return ramp 10. The use of a net is not unique but is a necessary component of this new game device.

This is a three dimensional table game of skill because the ball 13 is loaded, onto the paddle 4 and into the serving hole 7 carefully aimed and shot at the opponent's goal using all interior surfaces.

Figure 5:
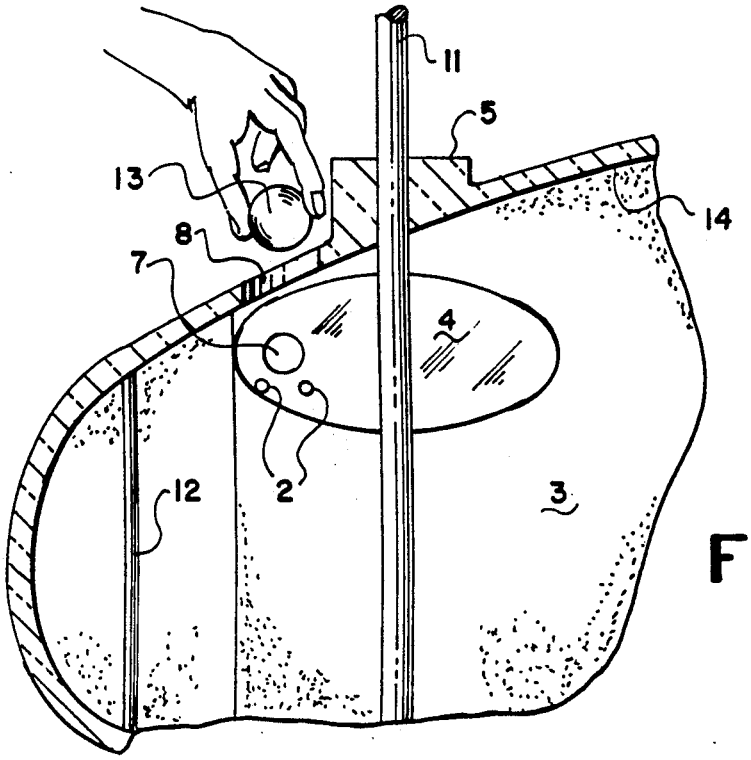
FIG. 5 is a top view of a ball being loaded through the loading hole, in the goal area
Figure 6:
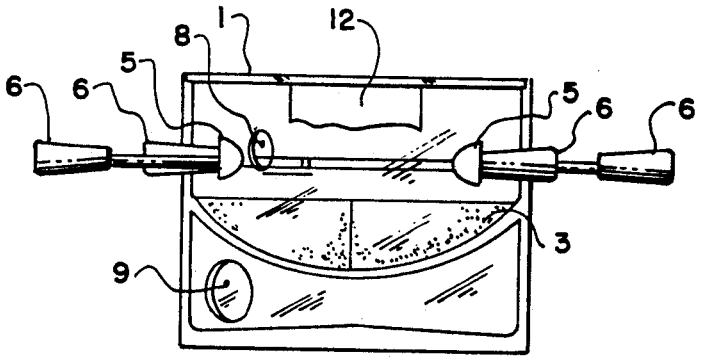
FIG. 6 is a center cut, rear view illustrating the sloping play deck

The shape of the paddle4 must parallel the sides of the goal area in the game device, in order to be able to spin freely while defending FIG. 5 & 9.

The paddle 4 must be center mounted, on the paddle rod 11 to be able to block shots over and under the defenders paddle rod FIG. 7.

Please note, an oval two player game device was chosen to illustrate the various functions of this new invention but almost any geometric shape will work and the device could be built for 3 or more players.

These game devices can be built out of sheet metal, wood, plastic, cement, fiber glass or other commonly available building materials. The idea of a table racket ball game device played in three dimensions, with a light weight ball is the basis of my claims: with the understanding that actual size, shape or material used is up to the individual and yet still fall within the spirit and scope of this patent application.

A common light weight table tennis ball 13 is used but almost any small light weight ball can be used.

The top 1 should be clear and strong enough to withstand impact of what ever type ball chosen. The clear top gives the three dimensional capabilities by adding an additional playing surface, for combination shots FIG. 7.

Figure 1:
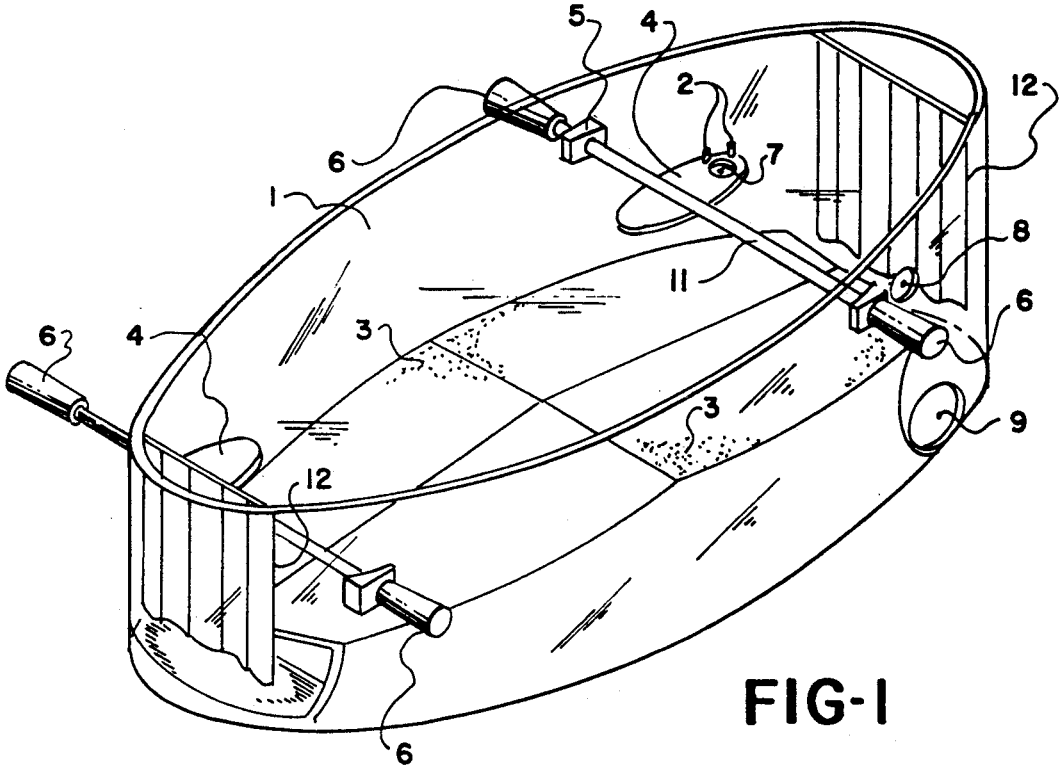
FIG. 1 is a clear three dimensional perspective of a two player oval table game device
Figure 2:
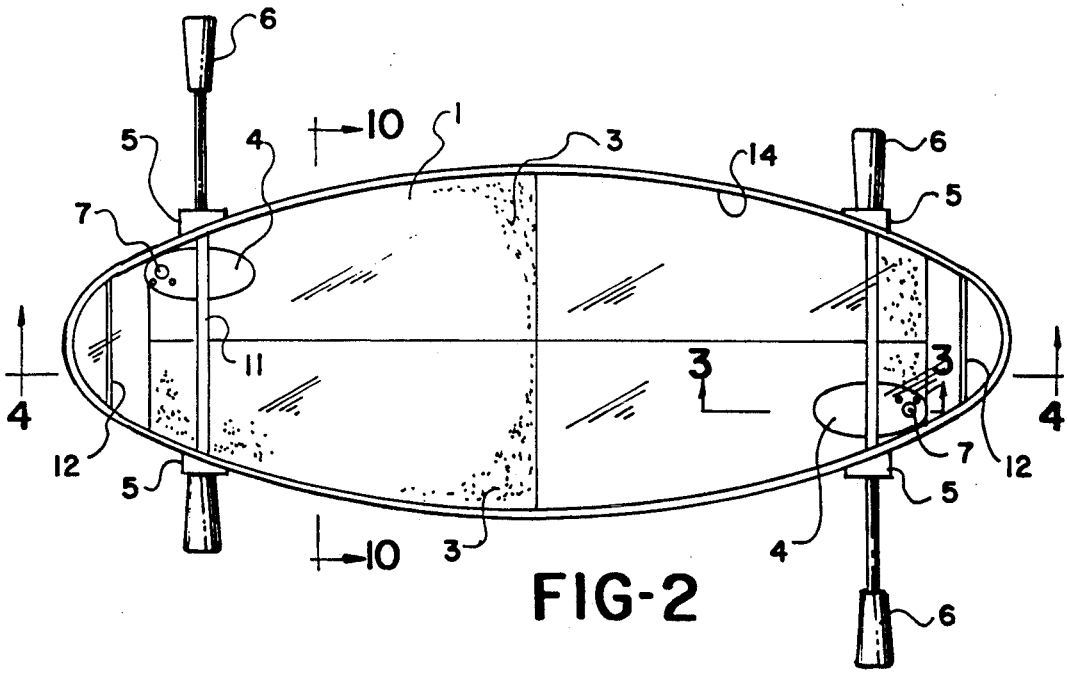
FIG. 2 is an overhead view of a two player oval
Figure 10:
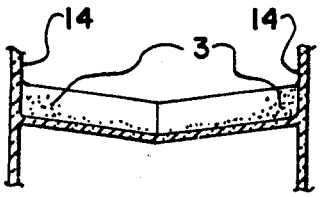
FIG. 10 is a cut away illustrating the inwardly sloping play deck
Figure 3:
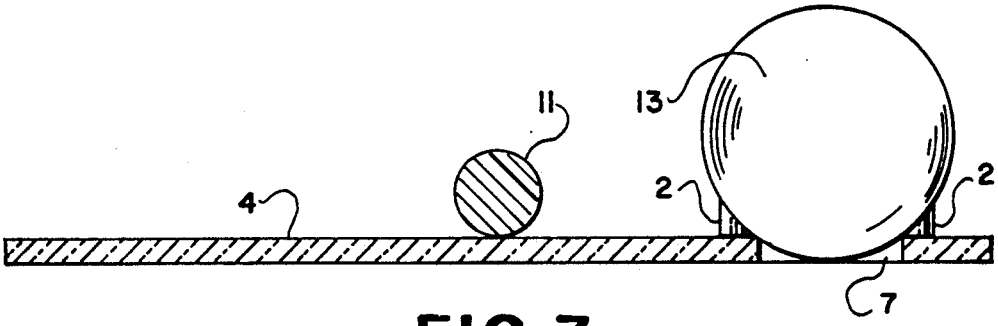
FIG. 3 is a side view of a paddle, rod, ball stops and ball
Figure 4:
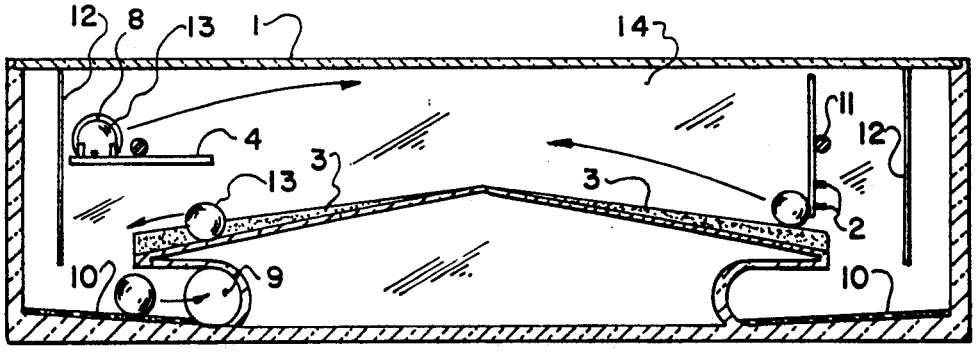
FIG. 4 is a center cut-side view of a two player game

The play deck 3 slopes in from the vertical sides FIG. 10 and down from the center FIG. 4. This eliminates the need for multiple paddles and is found in many games. Once again not a unique feature but serves a necessary function, in this new table game device.

The paddle rods 11 should be thick enough to withstand moderate abuse and of a material that doesn't tarnish or bend easily, such as stainless steel. These rods should be mounted through nylon bearings 5, which are slick, long wearing and never need lubrication. The rubber handles 6 help get a better grip and double, as bumpers as well.

Neither the rods, nylon bearings or rubber handles are unique but also serve valuable functions in this new device.

The loading hole 8 is unique and allows precision ball loading. The loading hole 8 FIG. 5 should be just slightly bigger than the play ball chosen, to prevent curious fingers access to the interior of the game. The bottom of the loading hole 8 should be even with the paddle 4, when held in a horizontal position FIG. 5. Thereby when the player loads the ball 13 through the loading hole 8, onto the serving hole 7 he doesn't lose a shot because the ball falls off. The ball stops 2 prevent the ball from falling off the opposite side of the paddle 4 if hurriedly loaded.

This new three dimensional table game device requires 100% concentration but little strength. Just a flick of the fingers sends the ball flying at the opponent. Any shot can be blocked if the player is fast enough. This new three dimensional game device develops concentration, skill and speed in eye-hand coordination. This new table game device challenges both young and old, to serious fun entertainment.

While I have described and illustrated the preferred embodiments of this invention, it is understood that modifications maybe made as desired, without departing from the spirit and scope of this invention.

What I claim is:

1. A table racket ball game device comprising;

a housing having top, bottom, end, and two side walls, two goals within the housing, one near each end thereof, each to be defended by a player, at least two paddle rods extending through said two side walls and slidable from side to side of said housing, and mounted for rotation on their axes, each said rod being mounted in front of one of said goals and having a handle mounted exteriorly of said housing, at least one paddle mounted, at its center, on each rod, each paddle having a serving hole near one end thereof, a ball, larger than said serving hole, placeable over said hole and being capable of being served by rotating said rod, thereby causing said ball to leave the paddle and bounce off of the top, sides and bottom of said housing toward the goal on the far end of the housing, said serving hole also being capable of catching and holding the ball before further serving, whereby a first player attempts to propel the ball into an opponent's goal and the opposing player attempts to catch, hold and then serve the ball back towards the first player's goal.

2. The game device of claim 1, further comprising;

a hole in each of the side walls, near one of the paddle rods, to permit manual loading of the paddles.

3. The game device of claim 1, wherein the bottom of the housing has a floor which is slanted upward from each of the ends of the housing, to meet at an apex in the center of the housing.

* * * * *